US006237789B1

(12) United States Patent
Zhu

(10) Patent No.: US 6,237,789 B1
(45) Date of Patent: May 29, 2001

(54) BURGLAR-PROOF CONTAINER COMPRISING A HOLLOW BODY WITH ITS CLOSING DEVICE

(76) Inventor: Mei Yi Zhu, 70 rue Vaneau, 75007, Paris (FR)

( * ) Notice: Subject to any disclaimer, the term of this patent is extended or adjusted under 35 U.S.C. 154(b) by 0 days.

(21) Appl. No.: 09/341,142

(22) PCT Filed: Jan. 16, 1998

(86) PCT No.: PCT/FR98/00075

§ 371 Date: Jul. 15, 1999

§ 102(e) Date: Jul. 15, 1999

(87) PCT Pub. No.: WO98/31599

PCT Pub. Date: Jul. 23, 1998

(30) Foreign Application Priority Data

Jan. 17, 1997 (FR) ..... 97 00485
Aug. 8, 1997 (FR) ..... 97 10207

(51) Int. Cl.[7] ..... B65D 1/02; B65D 39/00; B65D 50/00

(52) U.S. Cl. ..... 215/48; 215/50; 215/213; 215/256

(58) Field of Search ..... 215/48, 43, 49, 215/50, 209, 211, 251, 253, 263, 40, 47, 213, 256; 220/254, 266, 276

(56) References Cited

U.S. PATENT DOCUMENTS

| | | | | |
|---|---|---|---|---|
| 678,704 | * | 7/1901 | Weir | 215/49 |
| 2,059,012 | | 10/1936 | Morin . | |
| 2,072,701 | | 3/1937 | Barlow . | |
| 3,923,179 | * | 12/1975 | Choksi et al. | 215/203 |
| 5,090,581 | * | 2/1992 | Rose et al. | 215/48 |
| 5,409,125 | * | 4/1995 | Kimber et al. | 215/48 |
| 5,878,900 | * | 3/1999 | Hansen | 215/50 |

FOREIGN PATENT DOCUMENTS

| | | |
|---|---|---|
| 0 685 400 | 12/1995 | (EP) . |
| 428 277 | 3/1911 | (FR) . |
| 477 799 | 2/1914 | (FR) . |
| 541 518 | 9/1921 | (FR) . |
| 921 220 | 11/1945 | (FR) . |
| 1462827 | 12/1966 | (FR) . |
| 270971 | 11/1926 | (GB) . |

* cited by examiner

*Primary Examiner*—Allan N. Shoap
*Assistant Examiner*—Niki M. Eloshway
(74) *Attorney, Agent, or Firm*—Arent Fox Kintner Plotkin & Kahn, PLLC

(57) ABSTRACT

The invention concerns a burglar-proof container comprising a hollow body with its closing device, said hollow body comprising a fragile line (4) located on its neck (1) at some distance from the top of its mouth, which will be broken and destroyed if the container is opened.

10 Claims, 3 Drawing Sheets

BURGLAR-PROOF CONTAINER COMPRISING A HOLLOW BODY WITH ITS CLOSING DEVICE

Figure 2:
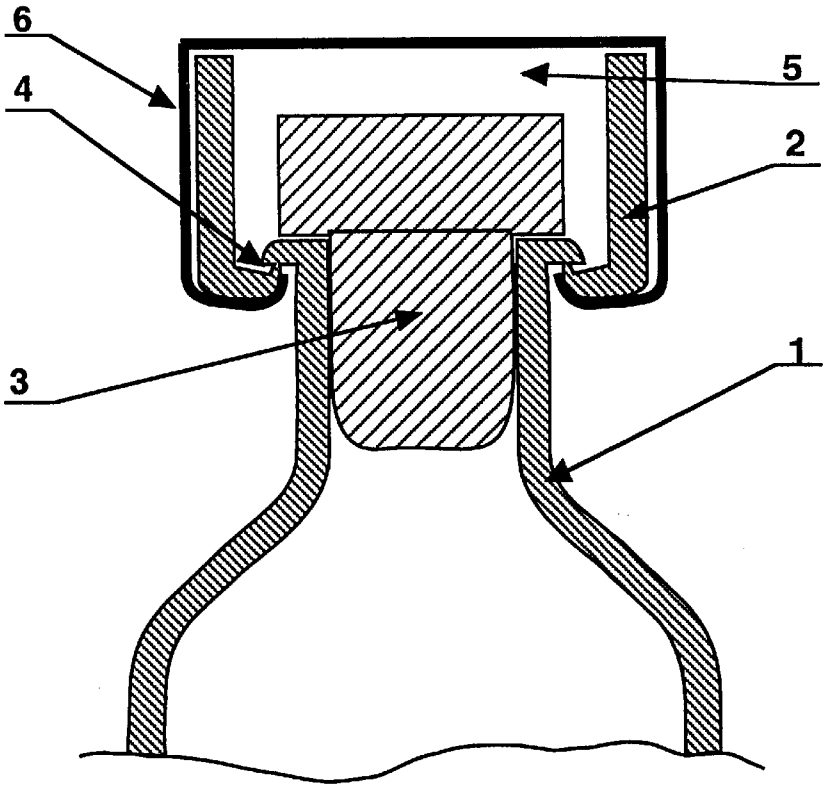

This invention relates to burglar-proof containers.

By container, we mean any hollow body with its locking system, such as, for instance: bottles, vials, vessels and/or other tanks. They are normally designed for launching quality products on the market, often under reputed names such as alcohols and/or spirits, champagnes and/or fine wines, perfumes and/or cosmetics, chemicals, farm-products or pharmaceuticals, sometimes of hazardous usage.

It is known that such containers are sometimes, unfortunately, reused by third parties, for launching products on the market that not only differ from those of origin, but often show lower quality, leading to the consumer's disappointment.

In this context, various devices have been designed with a view to enabling to detect whether such containers have been opened and to making them burglar-proof, seals are for instance provided between the neck of a bottle and its stopper, so that the seal will be broken when the bottle is opened.

Thus, among others, European Patent no 94 4402 006.4, published on Mar. 15 1995 under no. 0 642 984 A1, discloses an "Opening indicating device for bottles with stoppers, comprising means linking by a frangible area to a ring connected to the neck in a burglar-proof manner, so that the said means break at the location of the frangible area when they are brought from a protection position in which they oppose the removal of the stopper, to a stopper releasing position.

If this type of device enables to detect an opening, causing such a seal to break, it obviously does not prevent any possible reuse of the said bottles, without detecting such an intrusion.

Besides, French Patent no 89 17563, published on Jun. 28, 1991 under no. 2 656 281, discloses a "burglar-proof sealing device for a fragile vessel, comprising a sealing or supersealing system made of a ductile material, fixed to the said vessel and having an opening means, for example a line of fracture or a tearing line covering a crimping retainer; this device also comprises a wafer, acting as an antifraud seal, fixed simultaneously to the said sealing or supersealing system and to the vessel." This wafer, of reduced resilience, normally less than that of the vessel properly speaking, breaks during any attempted opening, by breaking the fixture of this sealing plate; if such were not the case, this attempted opening would cause the vessel itself to break, in an erratic, undefined and uncontrolled, even hazardous, manner.

Conversely, the container subject matter of the present invention, is really burglar-proof, because its opening forcibly implies elimination of the upper section of the neck of the said container, in a predefined, controlled, safe and final manner, making any reuse of the said container totally impossible, thanks to the obvious detection of this elimination.

The burglar-proof container, subject matter of the present invention, which comprises a hollow body with its closing system, is characterised in that this hollow body comprises a means integral with the neck of the hollow body, provided at a certain distance from the top of the mouth.

This means which constitutes a line of fracture of the neck of the hollow body and which will be broken at the opening of the container, is tapered and arranged at a certain distance from the top of the mouth of the hollow body, according to the invention: for example in the form o at least one recess, more or less circular, as a groove and/or a scratch, partial or total.

If, according to a preferred embodiment of the invention, this taper is machined when manufacturing this hollow body; the said groove or scratch can also be provided at a later stage, even when closing the container, using a tool such as a diamond.

The hollow body making up the said containers can be obtained from various materials (such as: glass, quartz, crystal, preferably: ceramics, porcelains, etc.) according to any technique known by the man skilled in the art, in relation to the material implemented and to the application contemplated, such as, for example: moulding, rotational moulding, forming; thermoforming, casting, centrifugal casting, spinning, extrusion, blow-moulding, machining or others.

The closing system, subject matter of the invention, which comprises a stopper and a capsule, commonly called a supersealing, possibly burglar-proof, capsule, is characterised in that the resilience of this capsule, in its weakest point of possible fracture, is greater than that of the line of fracture, a means destroyed when opening the container properly speaking.

The skirt of the stopper, usually made of cork, but which can also be of plastic material, is frequently topped with a head of relatively hard material, known, such as a thermosettable synthetic resin; this head is often decorated, especially for products with reputed names.

The burglar-proof supersealing capsule, possibly known in itself, is made of a material having mechanical characteristics necessary to meet the resilience defined above and enable final shaping when applied onto the neck of the container, according to any technique known in itself by the man skilled in the art.

This material, which is generally metallic, among others, light alloys, for instance aluminum, tinplate, possibly steel, can also be of a thermosettable synthetic material, known in itself, possibly translucent.

When this capsule is placed on the neck of the container, the lower section of its skirt must be fixed in a manner sufficiently integral with the said neck, possibly sealed, so that the said capsule is burglar-proof, as defined above; this fixture will be provided on the external face of the neck of the vessel and preferably in the vicinity of the said breakage means of this neck, as illustrated for example on the figures and in the embodiments below, according to any technique known by the man skilled in the art, among others, using high adhesive characteristic glues.

The line of fracture, constituting the opening means of the container according to the invention is broken, and the upper section of its neck is subsequently eliminated thanks to various mechanical and/or physical processes, known in themselves; among others, the processes indicated thereunder, for explanatory purposes and non limiting, which can be implemented separately or in combination, according to the case, as well as by any other process, equivalent in practice.

1. This breakage of the said means can be obtained by a pressure applied on the inner face of the neck and to the outside, in its upper section, more especially in the vicinity of the line of fracture, as illustrated on FIGS. 1, 2 and/or 3, appended.

This internal pressure can thus be provided via an element (see ref. 5) particularly arranged between the upper section of the neck (see ref. 2) and the stopper (see ref. 3); whereas the said element consists of, among others:

either of an elastic synthetic resin, having a hysteresis close to zero, such as a silicon for instance, or a mechanical spreading device, so that any pressure applied to such an element, such as a shock, onto the upper section of the supersealing capsule (see ref. 6) will be propagated almost integrally onto the internal face of this upper section of the neck (see ref. 2), thereby causing the said line of fracture to break (see ref. 4) and the separation of the upper section of the neck.

2. This breakage can also be obtained by a traction, torsional and/or rotational load, applied from the outside onto the upper section of the neck; whereby this load is imparted manually or, possibly, using a tool intended for this purpose, such as pliers.

3. This breakage can also be obtained by degrading the line of fracture, caused for instance by a friction liable to damage the structure of this line, possibly by abrasion, during a rotational load applied onto the supersealing capsule, among others.

4. This breakage can also be obtained by a thermal shock, applied in the vicinity of the line of fracture, by a heat conducting element, preferably metallic, such as among others aluminum, copper, tinplate or steel, whose coefficient of dilatation is sufficiently different from that of the material constitutive of the neck itself, so that rapid heating of this element causes the line of fracture to break, this heating can be generated by any means known, for instance induction.

As can be seen first of all on the 6 appended figures (FIGS. 1, 2, 3, 4, 5 and/or 6), which illustrate in a non limiting way the examples thereunder and represent certain embodiments of the invention, the references on these figures correspond to the following elements:

Ref. 1, neck of a glass bottle (or similar)

Figure 4:
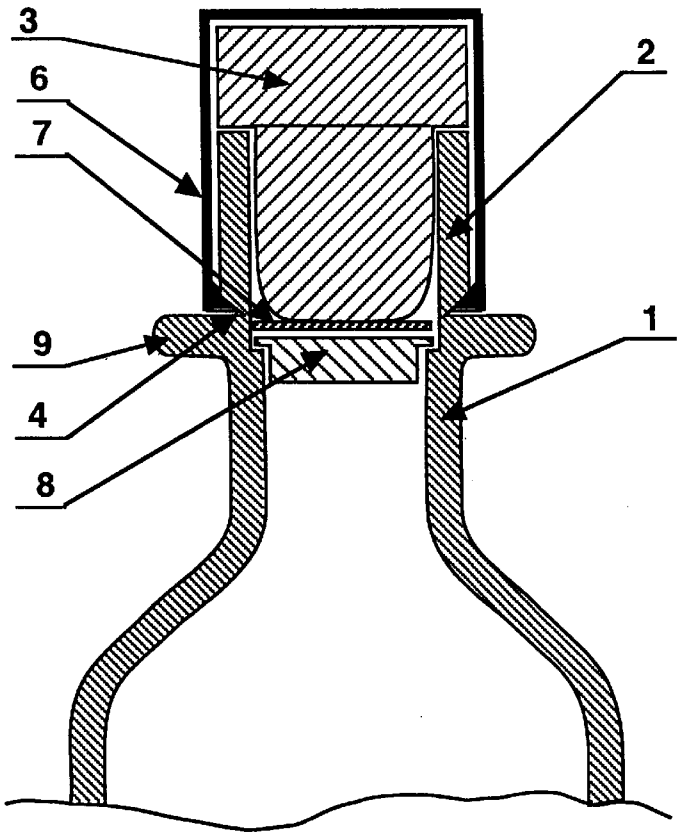

Ref. 2, integral upper section of the neck or mouth, which will be separated and eliminated when opening the bottle y breaking a line of fracture (4);

Ref. 4, line of fracture, provided in the neck, in a predetermined manner, either during the manufacture of the bottle properly speaking, or at a later stage for instance during closing;

Ref. 3, stopper (head and skirt);

Ref. 5 (FIGS. 1 and/or 2), elastic, synthetic material, and not exhibiting any hysteresis;

Ref. 5 (FIG. 3) mechanical spreading device;

Ref. 6, a supersealing capsule,

Ref. 7, FIG. 4) disk and (FIG. 5) cup;

Ref. 8 (FIGS. 4 and/or 5) capsule of plastic material;

Ref. 9 (FIGS. 4, 5 and/or 6), an embossed ring, derived from the manufacture of the bottle, reinforcing the top of the lower section of its neck, liable to avoid, if necessary, any uncontrolled breakage of the line of fracture, when closing this bottle;

Ref. 10 (FIG. 6), heat-conducting element;

Ref. 11 (FIG. 6), conducting wire, linking the element (Ref. 10) to a wafer (Ref. 12).

Figure 1:
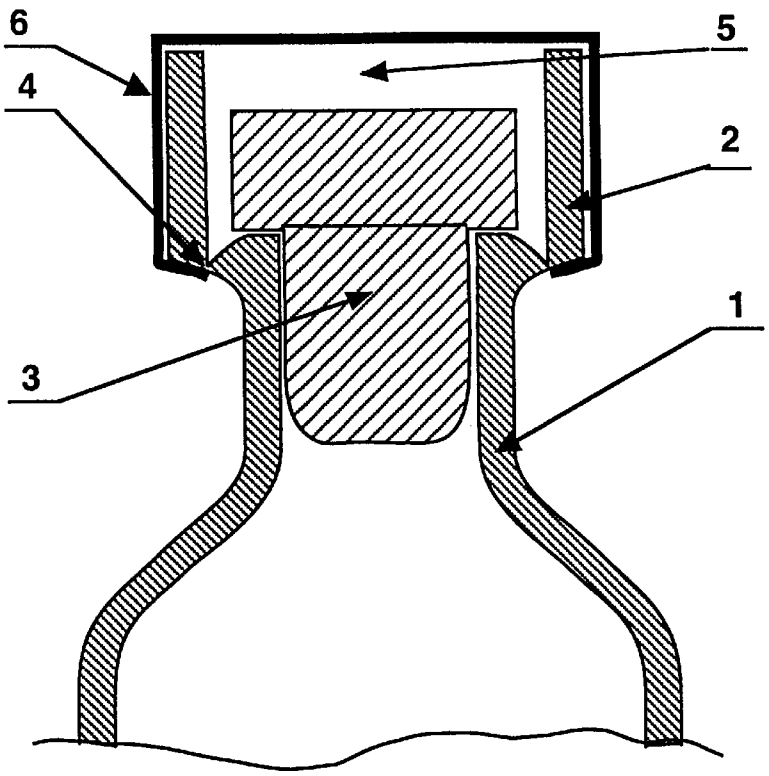

Thus, according to the example on FIG. 1, the following elements are arranged when closing the bottle: a cup, preferably prefabricated, based on silicon resin (5), covering the head of the stopper (3) and extending between this head and along the internal face of the upper section (2) of the neck of this bottle, reaching substantially the line of fracture (4), then a supersealing capsule (6) made of high mechanical characteristic aluminum alloy, covering the whole upper section of this prefabricated cup, as well as the external face of the section (2) of the neck of the bottle and whose base of the skirt is fixed solidly, for instance glued, to the lower surface of this section (2), in the vicinity of the line (4) making the said bottle burglar-proof.

When a rapid and sufficient pressure is applied, for example a sharp stroke on the head of the capsule (6), this pressure, while propagating substantially integrally onto the internal face of the neck (2), via the silicon cup (5), causes clear cut breakage of the line of fracture (4),—more or less without glass projections, taking into account the relative specifications of the said glass—, thereby enabling to open this bottle, by elimination of the upper section of its neck.

According to the example of FIG. 2, all things remaining equal moreover to those of FIG. 1, the sole differences relate, on the one hand, to the arrangement of the line of fracture (4) at the base of the section (2) of the neck of the bottle, and on the other hand, to the material constituting the capsule (6), which is a thermosettable resin, with high mechanical characteristics, translucent, ensuring that this section (2) has not already been eliminated after breaking the line (4).

Figure 3:
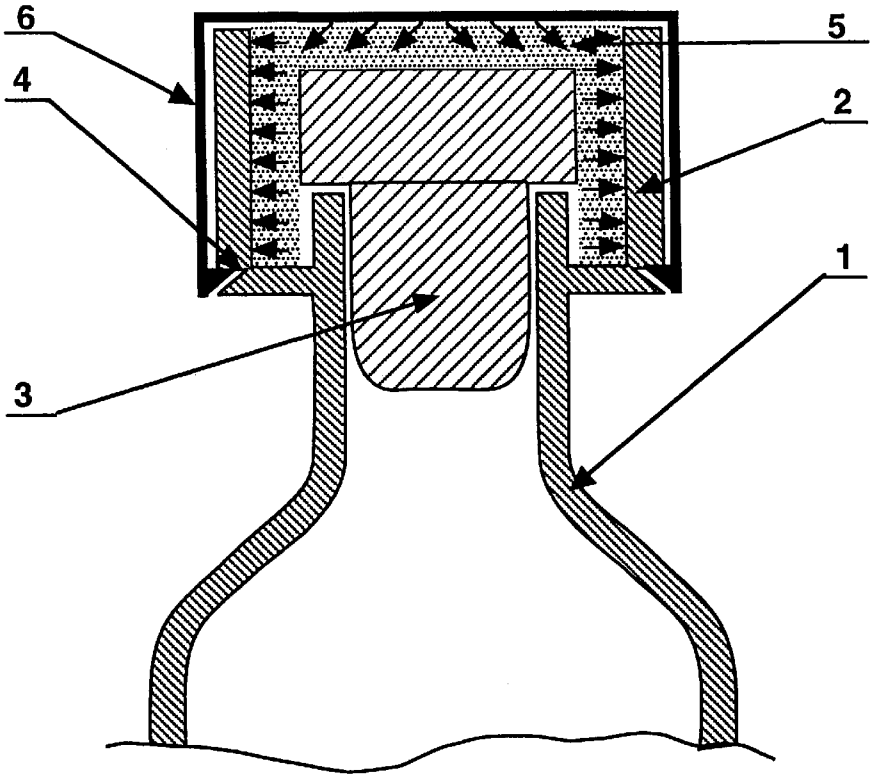

According to the example on FIG. 3, all things remaining equal, with respect to those on FIGS. 1 and/or 2, the sole difference relates to the cup (5) which is not made of synthetic material, such as silicon resin, but of a mechanical spreading device, which is equivalent and leads to the same result when sufficient pressure is imparted onto the top of the capsule (6), then causing the line of fracture (4) to break and the upper section of the neck (2) to be eliminated.

According to the example of FIG. 4, the following elements are arranged when closing the bottle: a disk of rigid material, preferably metallic—for instance tinplate, steel, aluminum, copper, etc.—, located under the foot of the skirt of the stopper (3) and under this disk, a capsule made of plastic material, such as other polyolefins, PVC or others, of low thickness, in the order of a few millimeters to one or two centimeters approx., having at its upper section a collar resting, as well as the said disk, on a slight half-flat, intended for that purpose at the top of the lower section of the neck of the bottle, so that the upper section of this disk is located substantially in the plane of the line of fracture (4), then a supersealing capsule (6) preferable metallic—for example, tinplate, steel, aluminum, copper, etc.—, extending downward, along the head of the stopper (3) and of the external face of the section (2) of the neck, whose base of the skirt is fixed solidly, by gluing, among others, to the lower part of this section (2), almost in contact with the line of fracture (4).

Figure 5:
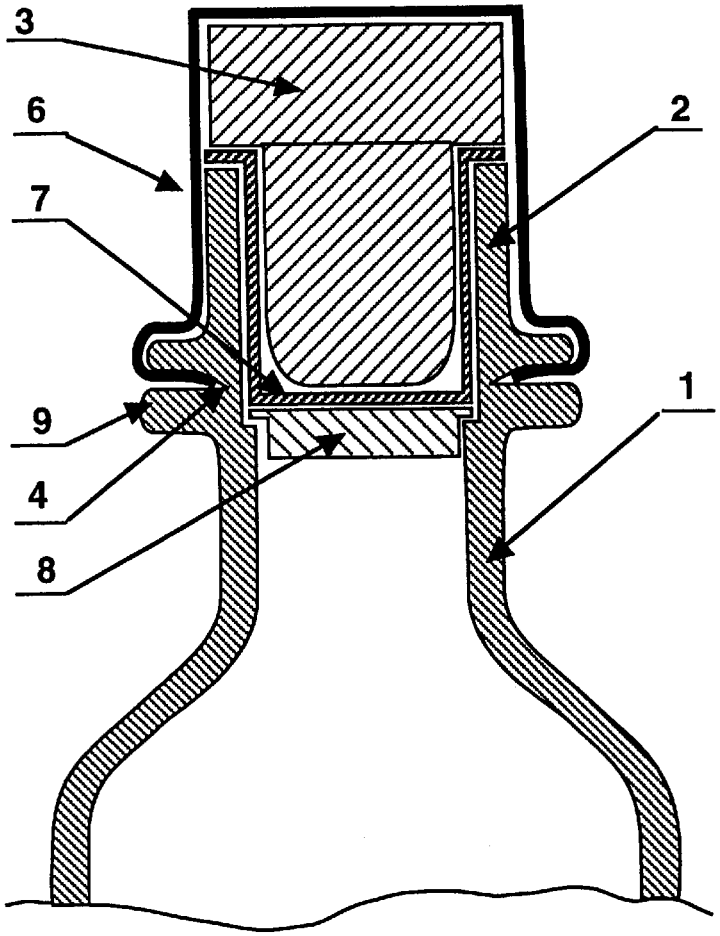

This bottle can be opened either using the operating method described thereunder in the example of FIG. 5 or by creating a thermal shock in the vicinity of the line of fracture (4), produced by rapid heating according to any means known, of the metal constituting the disk (7) and/or the capsule (6), intended for this purpose, which causes clear cut breakage of the line of fracture (4),—almost without any glass projections, taking into account the relative specifications of the said glass—, thus enabling opening this bottle, by elimination of the upper section of its neck. So, induction heating could be more suitable in the case of bottles of quality alcohol, intended for consumption in bars, discos or others.

According to the example of FIG. 5, all things remaining equal moreover to those of FIG. 4, the sole difference relates to the element (7) which is, not constituted by a rigid disk, but by a rigid cup surrounding the skirt assembly of the stopper (3).

When a traction, torsional and/or rotational load is imparted from the outside, manually, onto the upper section of the bottle, made of the set of elements, referred to (2, 3, 6 and 7) the line of fracture (4) is then clearly cut, almost without any glass projections, taking into account specific characteristics of the said glass—, leading to the opening of this bottle, while eliminating its upper section. If necessary, the presence of abrasive elements, at the end of the skirt of the capsule (6), in contact with the line of fracture (4), will facilitate this opening by rotation, causing a destructuring effect.

Figure 6:
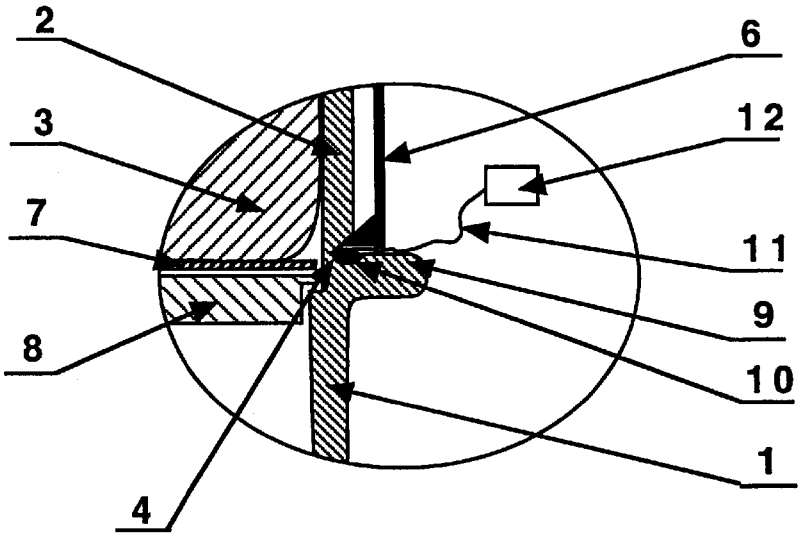

According to the example of FIG. 6, all things remaining equal besides to those of FIG. 4, which represents a special embodiment, a heat-conducting element (10)—among others, wire made of aluminum, copper, tinplate or steel, etc.—is either placed in close contact with the line of fracture (4) or even directly inserted into the material making up the neck of the bottle, at the location of this line of fracture, whereby an end of this wire is linked to the outside, using a strand of the said wire, up to a metallic wafer (12).

Rapid heating of the wire (10), which could be performed by induction, according to the metal making up the element (10), as well as intended for the example of FIG. 4, is generated accordingly in the present example, by direct heating through the wafer (12) and the strand (11), causing this bottle to open by imparting a thermal shock in the vicinity, of the line of fracture (4), which will be broken—almost without any glass projections, taking into account the specific characteristics of the said glass—, causing this bottle to open, with elimination of its upper section.

What is claimed is:

1. A burglar-proof bottle comprising a hollow body and a closing system, the hollow body having a neck with an upper section, a fragile portion, and a lower section, the lower section having an outwardly extending flange, the upper section is connected to the outwardly extending flange the fragile portion so that, by breaking the fragile portion, an upper section of the neck is separated from the body of the bottle, the closing system including a capsule enclosing the upper section of the neck above the fragile portion, the capsule having a skirt with a bottom edge solidly fixed with an external face of the neck of the bottle, in the vicinity of a line of fracture produced at the fragile portion.

2. A bottle according to claim 1, wherein the skirt of the capsule has a resilience greater than a resilience of the neck of the bottle in the vicinity of the fragile portion providing the line of fracture.

3. A bottle according to claim 1, wherein the fragile portion providing the line of fracture is moulded during manufacture of the hollow body.

4. A bottle according to claim 1, wherein the fragile portion providing the line of fracture is a groove or scratch.

5. A bottle according to claim 1, wherein the body further comprises a substantially embossed ring annularly provided on the neck, in the vicinity of and below the fragile portion providing the line of fracture.

6. A bottle according to claim 1, further comprising an inner capsule arranged inside the neck, in the vicinity of the fragile portion providing the line of fracture.

7. A bottle according to claim 1, further comprising a heat conducting element provided at the fragile portion, whereby breakage of the line of fracture is obtained by a thermal shock caused in the vicinity of this line of fracture when the heat conducting element is heated.

8. A bottle according to claim 7 wherein the lower section of the neck has a half-flat step portion on an inner surface thereof in the vicinity of and below the fragile portion providing the line of fracture, and the bottle further comprises an inner capsule arranged inside the neck having a collar resting on the half-flat, and wherein the heat conducting element is a metal disk on the inner capsule.

9. A bottle according to claim 1, further comprising a heat conducting element provided at the fragile portion, and wherein the skirt of the capsule is metal acting as the heat conducting element, whereby breakage of the line of fracture is obtained by a thermal shock, resulting from rapid heating of the metal of the skirt of the capsule when the heat conducting element is heated.

10. A bottle according to claim 1, wherein the closing system further includes a stopper positioned in the mouth, and the capsule surrounds at least a portion of the stopper.

* * * * *

UNITED STATES PATENT AND TRADEMARK OFFICE
Certificate

Patented: May 29, 2001

Patent No. 6,237,789 B1

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Mei Yi Zhu, Paris, France; Zhong Ming Zhu, Lu Wan Qu, Shanghai, People's Republic of China; and Bernard de Passemar, Paris, France.

Signed and Sealed this Twenty-First Day of August, 2001.

ALLAN N. SHOAP
*Supervisory Patent Examiner*
Art Unit 3727